US012747067B2

(12) United States Patent
Adams et al.

(10) Patent No.: US 12,747,067 B2
(45) Date of Patent: Sep. 29, 2026

(54) DRINKING CONTAINER IN MODULAR SYSTEM

(71) Applicant: Milwaukee Electric Tool Corporation, Brookfield, WI (US)

(72) Inventors: Caleb C. Adams, Milwaukee, WI (US); George A. Barton, Mequon, WI (US); Evan Maverick James Quiros, Milwaukee, WI (US); Joshua D. Schneider, Grayslake, IL (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 53 days.

(21) Appl. No.: 18/593,186

(22) Filed: Mar. 1, 2024

(65) Prior Publication Data

US 2024/0343448 A1 Oct. 17, 2024

Related U.S. Application Data

(60) Provisional application No. 63/581,381, filed on Sep. 8, 2023, provisional application No. 63/515,487, filed on Jul. 25, 2023, provisional application No. 63/495,906, filed on Apr. 13, 2023.

(51) Int. Cl.
*B65D 25/24* (2006.01)

(52) U.S. Cl.
CPC ..... *B65D 25/24* (2013.01)

(58) Field of Classification Search
CPC .... B65D 25/24; B65D 25/22; B65D 21/0201; B65D 21/0204; B65D 21/0209; A47G 19/2205; A47G 23/02; A47G 23/0241; A45F 3/16; A45F 3/18; A45F 5/1583; A61J 9/0661
USPC .... 220/630, 23.2, 23.4, 23.6, 694, 703, 737, 220/738, 739, 751; 206/503, 504, 509, 206/514, 1.5
See application file for complete search history.

(56) References Cited

U.S. PATENT DOCUMENTS 3,424,334 A 1/1969 Goltz
4,919,296 A * 4/1990 Kirsh ..... B65D 77/0453 220/737
5,273,175 A * 12/1993 Apps ..... B65D 21/0204 206/203

(Continued)

FOREIGN PATENT DOCUMENTS

DE 202014103695 12/2014
EP 1724069 A2 11/2006

(Continued)

OTHER PUBLICATIONS

Inter Partes Review No. 2024-01400, "Petition for Inter Partes Review of U.S. Pat. No. 11,365,026" Filed Sep. 17, 2024, 147 pages.

(Continued)

*Primary Examiner* — Laura E. Parker
(74) *Attorney, Agent, or Firm* — Reinhart Boerner Van Deuren s.c.

(57) ABSTRACT

A container, such as a beverage container, is provided. The container includes a storage body and a support structure coupled to the storage body, such as to an exterior of the storage body. The support structure includes one or more couplers, such as male couplers and female couplers, configured to couple the container in a modular system.

22 Claims, 18 Drawing Sheets

(56) References Cited

U.S. PATENT DOCUMENTS

| | | | | |
|---|---|---|---|---|
| 5,573,140 | A * | 11/1996 | Satomi | B23K 1/008 220/592.27 |
| 5,890,613 | A | 4/1999 | Williams | |
| 6,412,663 | B1 * | 7/2002 | Adamson | A47G 23/0258 222/321.9 |
| 6,983,946 | B2 | 1/2006 | Sullivan et al. | |
| 8,740,010 | B1 | 6/2014 | Page | |
| 9,375,835 | B1 | 6/2016 | Lin | |
| 10,583,962 | B2 | 3/2020 | Brunner et al. | |
| 10,750,833 | B2 | 8/2020 | Burchia | |
| 2003/0139080 | A1 | 7/2003 | Lafragette et al. | |
| 2004/0000550 | A1 * | 1/2004 | Taccolini | B65D 67/02 220/23.4 |
| 2007/0138041 | A1 | 6/2007 | Welsh | |
| 2011/0260588 | A1 | 10/2011 | Lin | |
| 2013/0127129 | A1 | 5/2013 | Bensman et al. | |
| 2014/0265440 | A1 | 9/2014 | Chen et al. | |
| 2017/0166352 | A1 | 6/2017 | Hoppe et al. | |
| 2017/0217634 | A1 * | 8/2017 | Hendrickson | B65D 21/0231 |
| 2019/0225371 | A1 | 7/2019 | Hoppe et al. | |
| 2020/0147781 | A1 | 5/2020 | Squiers et al. | |
| 2020/0165036 | A1 * | 5/2020 | Squiers | A45C 7/0045 |
| 2021/0345805 | A1 | 11/2021 | Keast et al. | |
| 2023/0122425 | A1 | 4/2023 | Camp et al. | |

FOREIGN PATENT DOCUMENTS

| | | | | |
|---|---|---|---|---|
| EP | 2537641 | B1 | 9/2016 | |
| EP | 2338650 | B1 | 10/2016 | |
| GB | 2211486 | | 7/1989 | |
| WO | WO-9616874 | A1 * | 6/1996 | B65D 81/361 |
| WO | WO2014/125484 | | 8/2014 | |

OTHER PUBLICATIONS

Exhibit 1001 in "Petition for Inter Partes Review of U.S. Pat. No. 11,365,026" Filed Sep. 17, 2024, 66 pages.
Exhibit 1002 in "Petition for Inter Partes Review of U.S. Pat. No. 11,365,026" Filed Sep. 17, 2024, 324 pages.
Exhibit 1003 in "Petition for Inter Partes Review of U.S. Pat. No. 11,365,026" Filed Sep. 17, 2024, 139 pages.
Exhibit 1004 in "Petition for Inter Partes Review of U.S. Pat. No. 11,365,026" Filed Sep. 17, 2024, 17 pages.
Exhibit 1005 in "Petition for Inter Partes Review of U.S. Pat. No. 11,365,026" Filed Sep. 17, 2024, 9 pages.
Exhibit 1006 in "Petition for Inter Partes Review of U.S. Pat. No. 11,365,026" Filed Sep. 17, 2024, 21 pages.
Exhibit 1007 in "Petition for Inter Partes Review of U.S. Pat. No. 11,365,026" Filed Sep. 17, 2024, 16 pages.
Exhibit 1008 in "Petition for Inter Partes Review of U.S. Pat. No. 11,365,026" Filed Sep. 17, 2024, 31 pages.
Exhibit 1009 in "Petition for Inter Partes Review of U.S. Pat. No. 11,365,026" Filed Sep. 17, 2024, 6 pages.
Exhibit 1010 in "Petition for Inter Partes Review of U.S. Pat. No. 11,365,026" Filed Sep. 17, 2024, 4 pages.
Exhibit 1011 in "Petition for Inter Partes Review of U.S. Pat. No. 11,365,026" Filed Sep. 17, 2024, 16 pages.
Exhibit 1012 in "Petition for Inter Partes Review of U.S. Pat. No. 11,365,026" Filed Sep. 17, 2024, 8 pages.
Exhibit 1013 in "Petition for Inter Partes Review of U.S. Pat. No. 11,365,026" Filed Sep. 17, 2024, 19 pages.
Exhibit 1014 in "Petition for Inter Partes Review of U.S. Pat. No. 11,365,026" Filed Sep. 17, 2024, 35 pages.
Exhibit 1015 in "Petition for Inter Partes Review of U.S. Pat. No. 11,365,026" Filed Sep. 17, 2024, 11 pages.
Exhibit 1016 in "Petition for Inter Partes Review of U.S. Pat. No. 11,365,026" Filed Sep. 17, 2024, 193 pages.
Exhibit 1017 in "Petition for Inter Partes Review of U.S. Pat. No. 11,365,026" Filed Sep. 17, 2024, 29 pages.
Exhibit 1018 in "Petition for Inter Partes Review of U.S. Pat. No. 11,365,026" Filed Sep. 17, 2024, 15 pages.
Exhibit 1019 in "Petition for Inter Partes Review of U.S. Pat. No. 11,365,026" Filed Sep. 17, 2024, 19 pages.
Exhibit 1020 in "Petition for Inter Partes Review of U.S. Pat. No. 11,365,026" Filed Sep. 17, 2024, 18 pages.
Exhibit 1021 in "Petition for Inter Partes Review of U.S. Pat. No. 11,365,026" Filed Sep. 17, 2024, 313 pages.
Exhibit 1030 in "Petition for Inter Partes Review of U.S. Pat. No. 11,365,026" Filed Sep. 17, 2024, 95 pages.
Exhibit 1031 in "Petition for Inter Partes Review of U.S. Pat. No. 11,365,026" Filed Sep. 17, 2024, 5 pages.
Exhibit 1032 in "Petition for Inter Partes Review of U.S. Pat. No. 11,365,026" Filed Sep. 17, 2024, 19 pages.
Inter Partes Review No. 2024-01401, "Petition for Inter Partes Review of U.S. Pat. No. 11,794,952" Filed Sep. 17, 2024, 165 pages.
Exhibit 1001 in "Petition for Inter Partes Review of U.S. Pat. No. 11,794,952" Filed Sep. 17, 2024, 67 pages.
Exhibit 1002 Part 1 in "Petition for Inter Partes Review of U.S. Pat. No. 11,794,952" Filed Sep. 17, 2024, 227 pages.
Exhibit 1002 Part 2 in "Petition for Inter Partes Review of U.S. Pat. No. 11,794,952" Filed Sep. 17, 2024, 278 pages.
Exhibit 1003 in "Petition for Inter Partes Review of US Pat. No. 11,794, 952" Filed Sep. 17, 2024, 168 pages.
Exhibit 1004 in "Petition for Inter Partes Review of U.S. Pat. No. 11,794,952" Filed Sep. 17, 2024, 17 pages.
Exhibit 1005 in "Petition for Inter Partes Review of U.S. Pat. No. 11,794,952" Filed Sep. 17, 2024, 9 pages.
Exhibit 1006 in "Petition for Inter Partes Review of U.S. Pat. No. 11,794,952" Filed Sep. 17, 2024, 21 pages.
Exhibit 1007 in "Petition for Inter Partes Review of U.S. Pat. No. 11,794,952" Filed Sep. 17, 2024, 16 pages.
Exhibit 1008 in "Petition for Inter Partes Review of U.S. Pat. No. 11,794,952" Filed Sep. 17, 2024, 31 pages.
Exhibit 1009 in "Petition for Inter Partes Review of U.S. Pat. No. 11,794,952" Filed Sep. 17, 2024, 6 pages.
Exhibit 1010 in "Petition for Inter Partes Review of U.S. Pat. No. 11,794,952" Filed Sep. 17, 2024, 4 pages.
Exhibit 1011 in "Petition for Inter Partes Review of US Pat. No. 11,794, 952" Filed Sep. 17, 2024, 16 pages.
Exhibit 1012 in "Petition for Inter Partes Review of U.S. Pat. No. 11,794,952" Filed Sep. 17, 2024, 8 pages.
Exhibit 1013 in "Petition for Inter Partes Review of U.S. Pat. No. 11,794,952" Filed Sep. 17, 2024, 19 pages.
Exhibit 1014 in "Petition for Inter Partes Review of U.S. Pat. No. 11,794,952" Filed Sep. 17, 2024, 35 pages.
Exhibit 1015 in "Petition for Inter Partes Review of U.S. Pat. No. 11,794,952" Filed Sep. 17, 2024, 11 pages.
Exhibit 1016 in "Petition for Inter Partes Review of U.S. Pat. No. 11,794,952" Filed Sep. 17, 2024, 193 pages.
Exhibit 1017 in "Petition for Inter Partes Review of U.S. Pat. No. 11,794,952" Filed Sep. 17, 2024, 29 pages.
Exhibit 1018 in "Petition for Inter Partes Review of U.S. Pat. No. 11,794,952" Filed Sep. 17, 2024, 15 pages.
Exhibit 1019 in "Petition for Inter Partes Review of U.S. Pat. No. 11,794,952" Filed Sep. 17, 2024, 19 pages.
Exhibit 1020 in "Petition for Inter Partes Review of U.S. Pat. No. 11,794,952" Filed Sep. 17, 2024, 18 pages.
Exhibit 1021 in "Petition for Inter Partes Review of U.S. Pat. No. 11,794,952" Filed Sep. 17, 2024, 313 pages.
Exhibit 1022 in "Petition for Inter Partes Review of U.S. Pat. No. 11,794,952" Filed Sep. 17, 2024, 324 pages.
Exhibit 1023 in "Petition for Inter Partes Review of U.S. Pat. No. 11,794,952" Filed Sep. 17, 2024, 5 pages.
Exhibit 1024 in "Petition for Inter Partes Review of U.S. Pat. No. 11,794,952" Filed Sep. 17, 2024, 7 pages.
Exhibit 1025 in "Petition for Inter Partes Review of U.S. Pat. No. 11,794,952" Filed Sep. 17, 2024, 15 pages.
Exhibit 1026 in "Petition for Inter Partes Review of U.S. Pat. No. 11,794,952" Filed Sep. 17, 2024, 37 pages.
Exhibit 1027 in "Petition for Inter Partes Review of U.S. Pat. No. 11,794,952" Filed Sep. 17, 2024, 7 pages.

(56) References Cited

OTHER PUBLICATIONS

Exhibit 1028 in "Petition for Inter Partes Review of U.S. Pat. No. 11,794,952" Filed Sep. 17, 2024, 33 pages.
Exhibit 1030 in "Petition for Inter Partes Review of U.S. Pat. No. 11,794,952" Filed Sep. 17, 2024, 95 pages.
Exhibit 1031 in "Petition for Inter Partes Review of U.S. Pat. No. 11,794,952" Filed Sep. 17, 2024, 5 pages.
Exhibit 1032 in "Petition for Inter Partes Review of U.S. Pat. No. 11,794,952" Filed Sep. 17, 2024, 60 pages.

* cited by examiner

DRINKING CONTAINER IN MODULAR SYSTEM

CROSS-REFERENCE TO RELATED PATENT APPLICATIONS

The present application claims the benefit of and priority to U.S. Provisional Application No. 63/581,381 filed on Sep. 8, 2023, U.S. Provisional Application No. 63/515,487, filed Jul. 25, 2023, and U.S. Provisional Application No. 63/495,906, filed Apr. 13, 2023, each of which is incorporated herein by reference in its entirety.

BACKGROUND OF THE INVENTION

The present disclosure is directed generally to the field of containers and related devices. The present disclosure relates specifically to a beverage container with one or more coupling mechanisms to detachably couple the beverage container to a utility module, such as a tool storage device, unit or container.

Tool storage units are often used to transport tools and tool accessories. Some storage units are designed to incorporate into a modular storage system. Various accessories can be configured to interface with a storage unit in a modular storage system, such as a container for beverages that couples to the modular storage system.

SUMMARY OF THE INVENTION

One embodiment of the invention relates to a container configured to pour a pourable material. The container includes a storage body defining a containment area configured to receive a pourable material, the storage body extending along a primary longitudinal axis, an opening defined by the storage body, the opening providing fluid communication between the containment area and an exterior of the storage body, a support structure detachably coupled to the storage body, and a plurality of female couplers extending from the support structure. Each of the plurality of female couplers includes a sidewall extending from the support structure, and a rib extending from the sidewall above and offset from the storage body. The support structure, the sidewall, and the rib collectively define a channel parallel to the primary longitudinal axis, and the channel extends from an open back end to an open front end.

Another embodiment of the invention relates to a container configured to pour a pourable material. The container includes a storage body defining a containment area configured to receive a pourable material, the storage body extending along a primary longitudinal axis, an opening defined by the storage body, the opening providing fluid communication between the containment area and an exterior of the storage body, a support structure detachably coupled to the storage body, and a plurality of male couplers extending from the support structure. Each of the plurality of male couplers includes a backwall extending from the support structure, an interior wall extending from the support structure, and a tongue extending from the interior wall offset from and above the support structure. The support structure, the backwall, the interior wall, and the tongue collectively define a channel parallel to the primary longitudinal axis, and the channel extends from a closed back end at the backwall to an open front end opposite the closed back end.

Another embodiment of the invention relates to a container configured to pour a pourable material. The container includes a storage body defining a containment area configured to receive pourable materials, an opening defined by the storage body, a support structure detachably coupled to the storage body, and a plurality of couplers extending from the support structure, the plurality of couplers configured to detachably couple the support structure to a modular storage system. The storage body includes an inner wall and an outer wall that define a vacuum-insulated area between the inner wall and the outer wall. The vacuum-insulated area provides thermal insulation between the containment area and an exterior of the storage body. The storage body is formed from a first material comprising a metal. The opening provides fluid communication between the containment area and the exterior of the storage body. The support structure is formed from a second material comprising a plastic.

Another embodiment of the invention relates to a drinking container including a storage body defining a containment area for pourable materials, an opening defined by the storage body, an upper support structure, a lower support structure detachably coupled to the upper support structure, a plurality of male couplers extending from a first side of the lower support structure, and a plurality of female couplers extending from a second side of the lower support structure opposite the first side. The opening provides fluid communication between the containment area and an exterior of the storage body. The upper support structure and lower support structure collectively extend around the storage body. Each of the plurality of male couplers includes a back wall, an interior wall extending away from the lower support structure, and a tongue extending from the back wall and the interior wall. The tongue is offset from and above the storage body. The back wall, the interior wall, and the tongue collectively define a channel that extends from a closed back end to an open front end. Each of the plurality of female couplers includes a sidewall extending away from the lower support structure, and a rib extending from the sidewall. The rib is above and offset from the storage body.

Another embodiment of the invention relates to a drinking container including a storage body defining a containment area for pourable materials, an opening defined by the storage body, the opening providing fluid communication between the containment area and an exterior of the storage body, a support structure coupled to the exterior of the storage body, the support structure including a first element and a second element coupled to each other, a plurality of male couplers extending from the first element, and a plurality of female couplers extending from the second element. Each of the plurality of male couplers includes a back wall and an interior wall extending away from the first element, a tongue extending from the back wall and the interior wall. The tongue is offset from and above the first element. The first element, the back wall, the interior wall, and the tongue collectively define a channel that extends from a closed back end to an open front end. A plurality of female couplers extends from the second element. Each of the plurality of female couplers includes a sidewall extending away from the second element, and a rib extending from the sidewall, the rib is above and offset from the second element.

In various specific embodiments, the plurality of male couplers are configured to couple to a first side of a utility module and the plurality of female couplers are configured to couple to a second side of the utility module opposite the first side.

Another embodiment of the invention relates to a drinking container including a storage body defining a containment area for pourable materials, the storage body including an inner wall and an outer wall that define a vacuum-insulated area between the inner wall and the outer wall, the vacuum-insulated area providing thermal insulation between the containment area and an exterior of the storage body, an opening defined by the storage body, the opening providing fluid communication between the containment area and the exterior of the storage body, and a support structure coupled to the exterior of the storage body, the support structure formed from a plastic material.

In various specific embodiments, the storage body is formed from a material including metal. In various specific embodiments, the drinking container includes a plurality of male couplers extending from the storage body and a plurality of female couplers extending from the storage body. The plurality of male couplers are configured to couple to a first side of a utility module and the plurality of female couplers are configured to couple to a second side of a utility module opposite the first side.

Additional features and advantages will be set forth in the detailed description which follows, and will be readily apparent to those skilled in the art from the description or recognized by practicing the embodiments as described in the written description and/or shown in the accompany drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments. In addition, alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
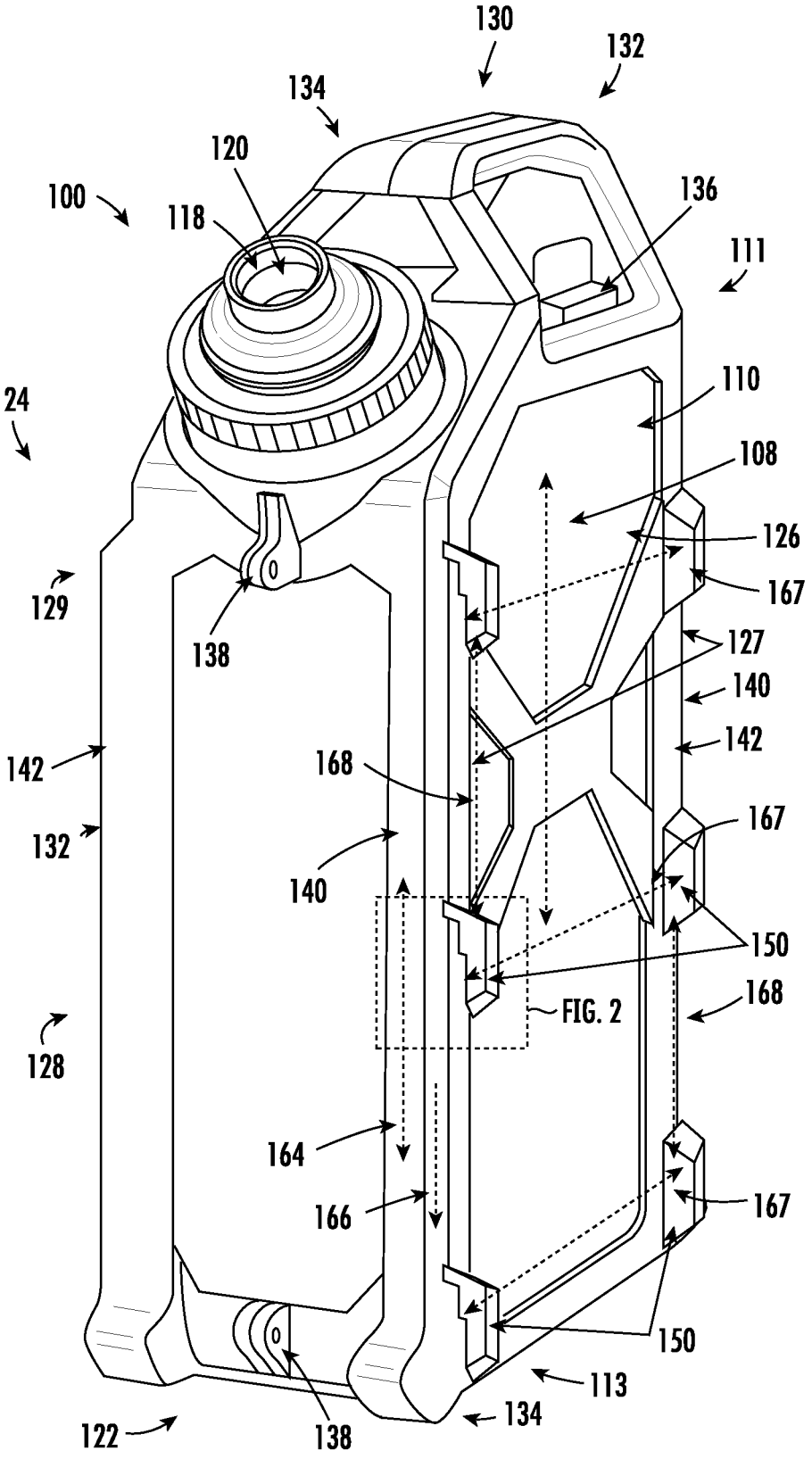
FIG. 1 is a perspective view of a drinking container, according to an exemplary embodiment.

Referring generally to the figures, various embodiments of a container are shown. One or more of the containers are configured to selectively couple and decouple with components in a modular storage system, such as a tool storage unit. The container includes a storage body and one or more couplers configured to couple to one or more coupling elements of a tool storage unit, such as one or more male couplers on a first side of the container and one or more female couplers on an opposing second side of the container. The male couplers and female couplers are configured to couple the beverage container between two utility modules in a modular storage system. Applicant has observed that integrating a container between utility modules provides more accessible coupling options for the container within a modular storage system, such as by not requiring the container to only be coupled to a certain portion of the modular storage system (e.g., the top or the side).

Still referring generally to the figures, various embodiments of another container are shown. One or more of the containers include a metallic storage body to store the pourable material, such as a vacuum-insulated metallic storage body, and a support structure coupled to and around the storage body, such as a plastic support structure. Applicant has observed that including a metallic vacuum-insulated container with a plastic support structure improves the user experience by providing a strong damage-resistant drinking vessel that is protected from damage by the malleable plastic support structure.

Referring generally to the figures, various embodiments of a containers are shown. In various embodiments the containers include a storage body with a vacuum sealed thermal insulation, such as a metal storage body, surrounded by a support structure, such as a plastic support structure, that includes one or more coupling elements to rigidly couple the container in a modular system.

Referring to FIGS. 1-6, various aspects of container 100 are shown. Container 100 is configured to pour a pourable material, such as a liquid, such as a liquid to be consumed by a user (e.g., water). Container 100 includes storage body 110 and support structure 130 coupled to an exterior 124 of storage body 110. In various embodiments, support structure 130 is detachably coupled to storage body 110. As will be shown, storage body 110 defines a containment area 118 configured to receive a pourable material, such as liquids, the storage body 110 extending along longitudinal axis 108.

Opening 120 is defined by storage body 110, and opening 120 provides fluid communication between containment area 118 and exterior 124 of storage body 110. In use, a user inserts a pourable material (e.g., a liquid) into storage body 110 via opening 120, and the user removes (e.g., drinks) the pourable material stored within storage body 110 via opening 120.

Support structure 130 includes a first element 132 and a second element 134, which are coupled (e.g., rigidly coupled) together, such as via fastener, shown as screw 138. First element 132 extends around first side 126 of storage body 110, and second element 134 extends around second side 128 of storage body 110 opposite first side 126.

A plurality of male couplers 150 extend from first side surface 127 of first side 126 of support structure 130. Female couplers 170 extend from second side surface 129 of support structure. In various embodiments, first side surface 127 and second side surface 129 are opposite each other and facing away from each other. In various embodiments, first side surface 127 and second side surface 129 extend between bottom 113 and top 111 of storage body 110. First element 132 includes arms 140 that extend from bottom surface 122 at bottom 113 of storage body 110 to top 111 of storage body 110, which is proximate opening 120. Second element 134 includes arms 142 that extend from bottom surface 122 at bottom 113 of storage body 110 to top 111 of storage body 110.

Container 100 includes latch 136 coupled to support structure 130. As will be shown, latch 136 laterally secures container 100 with respect to a utility module (e.g., utility module 180 in FIGS. 7-8) while male couplers 150 vertically secure container 100 with respect to the utility module. Thus, latch 136 and male couplers 150 collectively rigidly secure container 100 to a utility module (e.g., utility module 180 in FIGS. 7-8). In various embodiments, one or more of the plurality of male couplers 150 engage with a utility module (e.g., utility module 180) to detachably couple the support structure 130 to the utility module, and the latch 136 interfaces with the utility module to prevent sliding disengagement of the one or more plurality of male couplers 150 from the utility module.

In various embodiments, storage body 110 is formed from a first material including a metal, and support structure 130 is formed from a second material including a plastic material, such as a type of polyethylene. Applicant has observed that including a metallic beverage container (e.g., various embodiments of storage body 110) within a support structure 130 provides a strong damage-resistant vessel that is further protected by the malleable plastic support structure. In various embodiments, support structure 130 includes a plurality of couplers (e.g., male couplers 150 and/or female couplers 170) configured to detachably couple the support structure 130 to a modular storage system 198.

Figure 2:
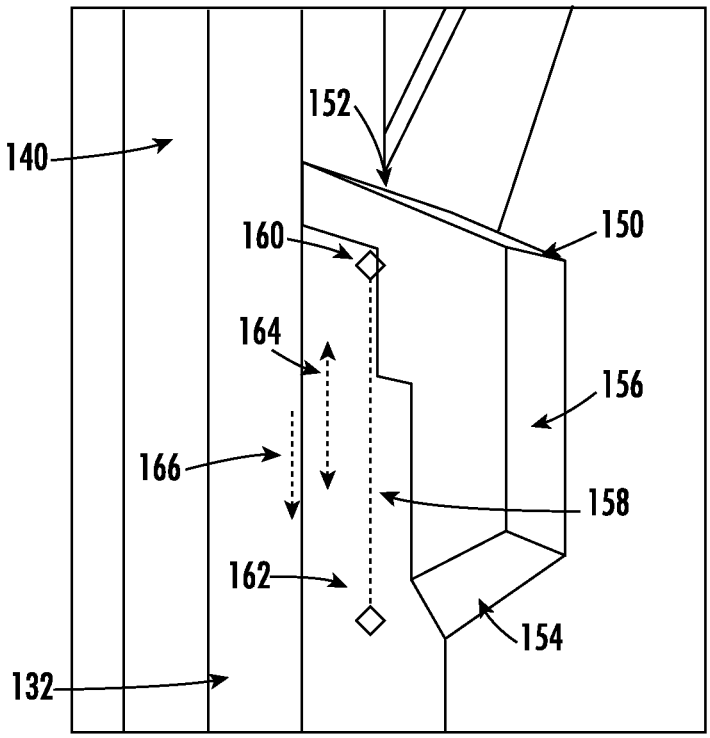
FIG. 2 is a detailed perspective view of the drinking container of FIG. 1, according to an exemplary embodiment.

Referring to FIG. 2, various aspects of male couplers 150 are shown. In various embodiments, container 100 includes a plurality of male couplers 150 extending from the support structure 130, such as from first side 126. Male couplers 150 extend from first side surface 127 away from second side surface 129. In various embodiments, each of male couplers 150 includes a backwall 152 extending from support structure 130 and an interior wall 154 extending from support structure 130. Each of male couplers 150 further includes a tongue 156 extending from backwall 152 and interior wall 154, the tongue 156 being offset from and above the support structure 130 and/or storage body 110. The support structure 130, backwall 152, interior wall 154, and tongue 156 collectively define channel 158, which extends from closed back end 160 at backwall 152 to an open front end 162 opposite closed back end 160. In various embodiments, channel 158 extends parallel to longitudinal axis 108.

In various embodiments, channel 158 extends along axis 164, which extends vertically between bottom surface 122 of storage body 110 and opening 120. In particular, channel 158 extends in downward direction 166 along axis 164. To couple male couplers 150 of container 100 to another object, container 100 is linearly slid in direction 166 with respect to the object to thereby engage male couplers 150 with female couplers of another object (e.g., female couplers 184 of utility module 180 in FIG. 7).

Figure 11:
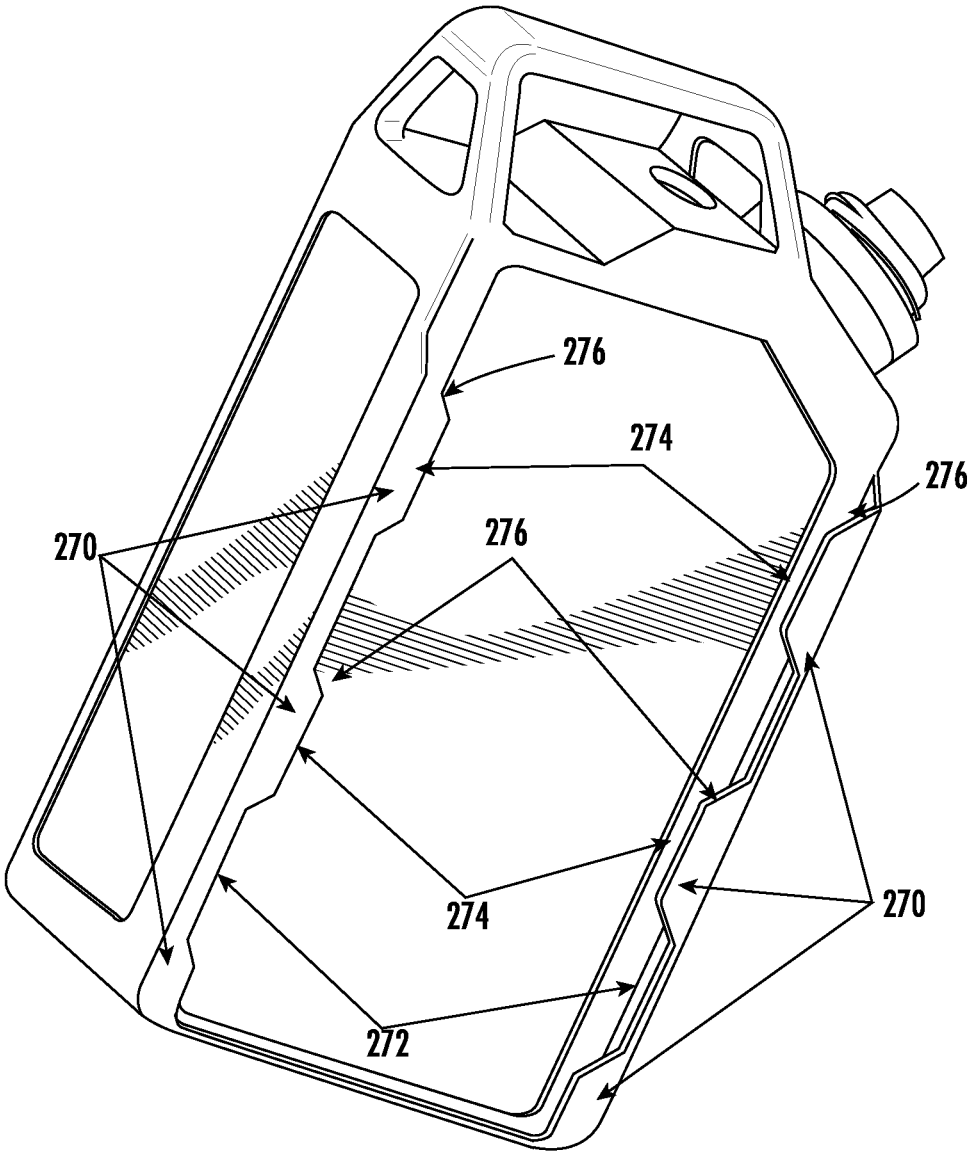
FIG. 11 is a perspective rear view of the drinking container of FIG. 10, according to an exemplary embodiment.
Figure 12:
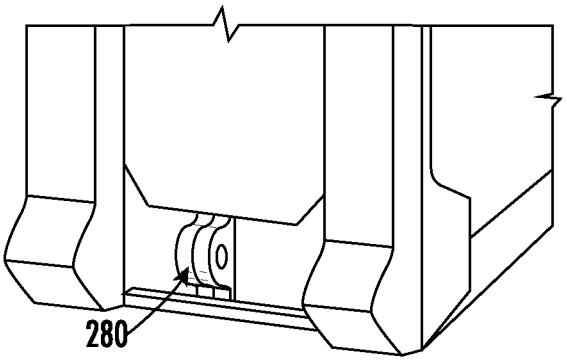
FIGS. 12-17 are detailed perspective views of coupling structures for support structures, according to exemplary embodiments.
Figure 13:
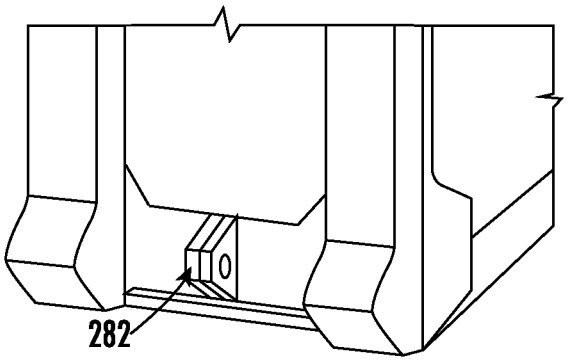
Figure 14:
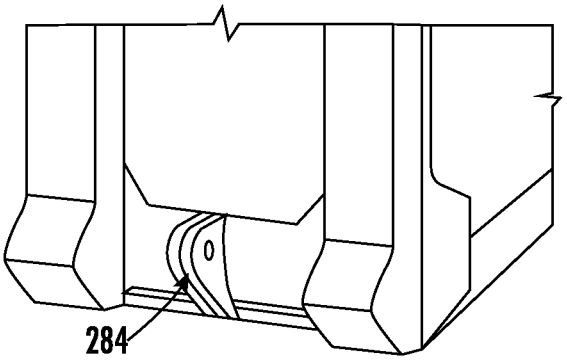
Figure 15:
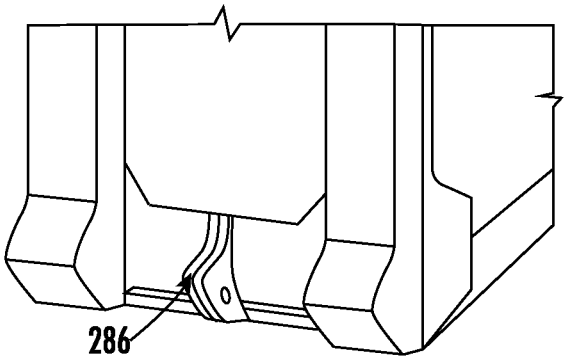
Figure 16:
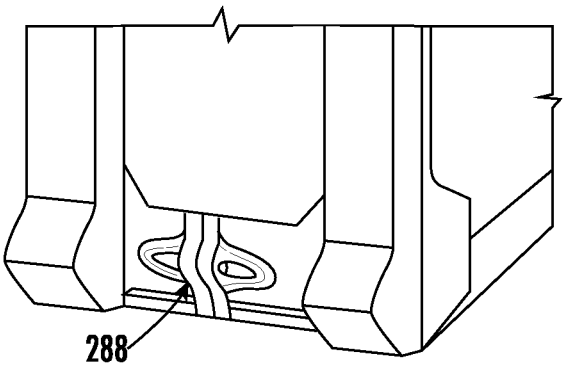
Figure 17:
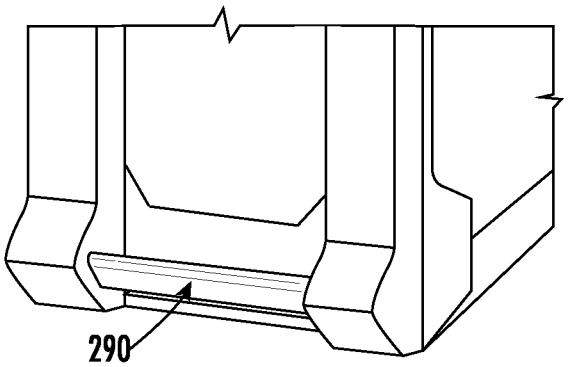

In various embodiments, container 100 includes female couplers 170 that are similar to or the same as female couplers 270 extending from support structure 230 of container 200 (see FIG. 11). For example, container 100 includes female couplers 170 extending from second element 134 of support structure 130 opposite male couplers 150 extending from first element 132 of support structure 130.

Figure 3:
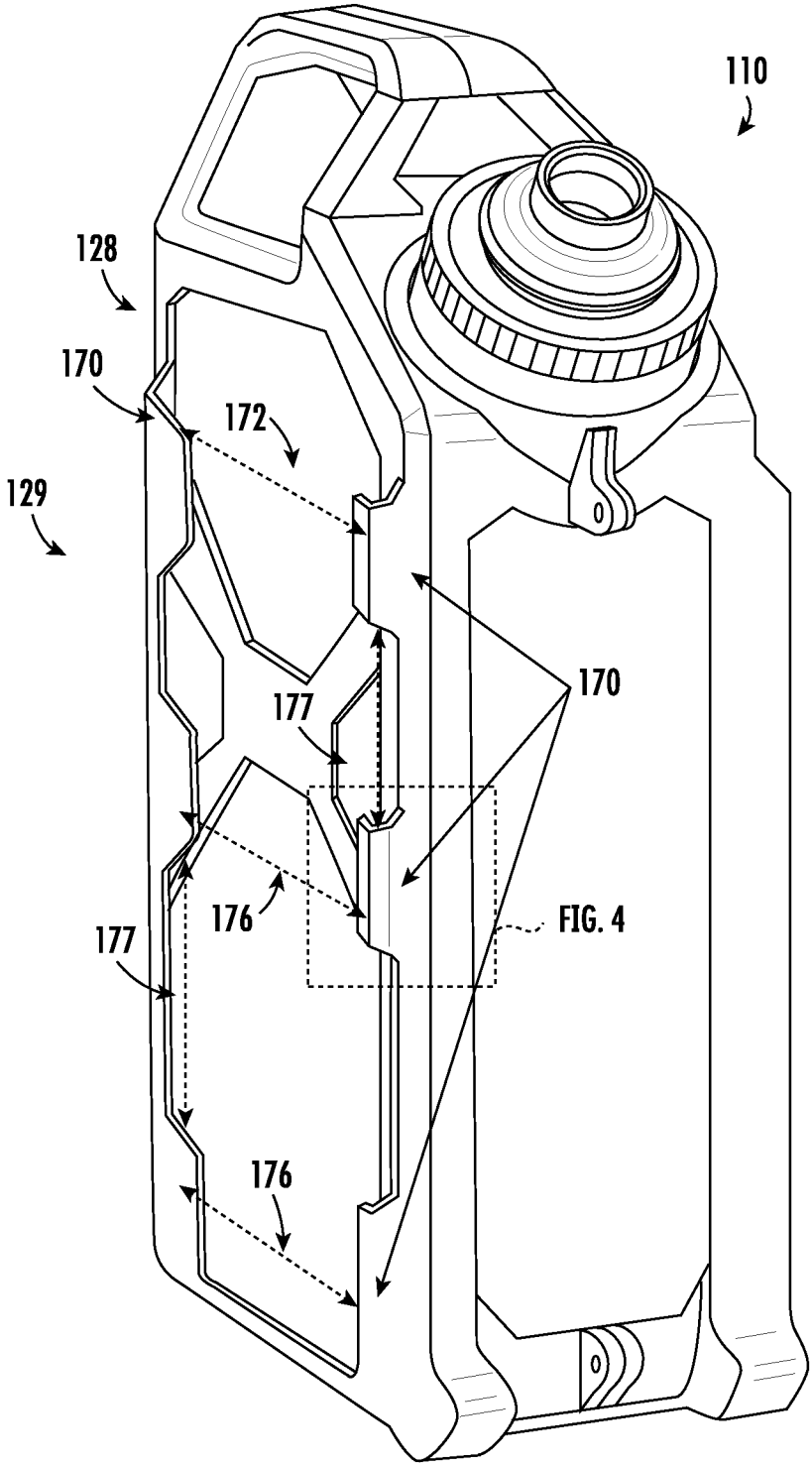
FIG. 3 is a perspective view of a rear of the drinking container of FIG. 1, according to an exemplary embodiment.
Figure 4:
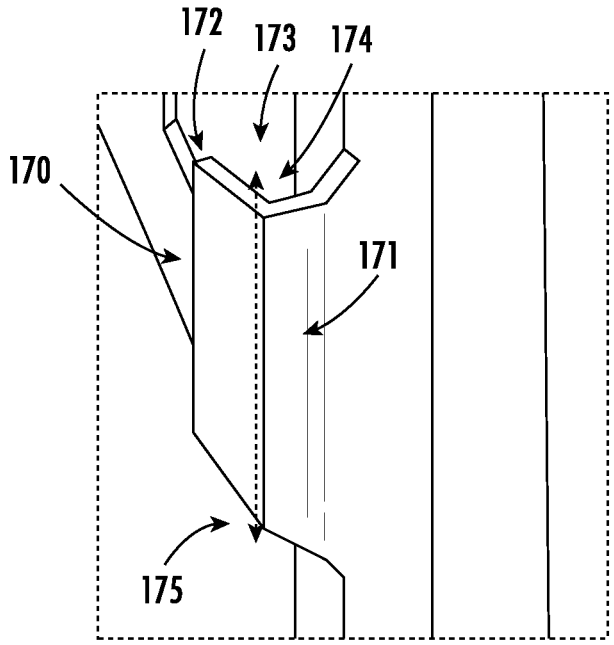
FIG. 4 is a detailed perspective view of the drinking container of FIG. 1, according to an exemplary embodiment.

Referring to FIGS. 3-4, various aspects of female couplers 170 are provided. In various embodiments, a plurality of female couplers 170 extend from support structure 130, such as from second side surface 129 of second side 128 of support structure. In various embodiments, each of the plurality of female couplers 170 includes a sidewall 171 extending from the support structure 130, and a rib 172 extending from the sidewall 171 above and offset from the storage body 110. The support structure 130, the sidewall 171, and the rib 172 collectively define a channel 173 parallel to the primary longitudinal axis 108, and the channel 173 extends from an open back end 174 to an open front end 175. In various embodiments, the plurality of female couplers 170 are arranged in a grid including at least two rows 176 of female couplers 170 and at least two columns 177 of female couplers 170. In various embodiments, plurality of male couplers 150 are arranged in a grid including at least two rows 167 of male couplers 150 and at least two columns 168 of male couplers 150. In various embodiments, channel 173 extends parallel to longitudinal axis 108.

Figure 21:
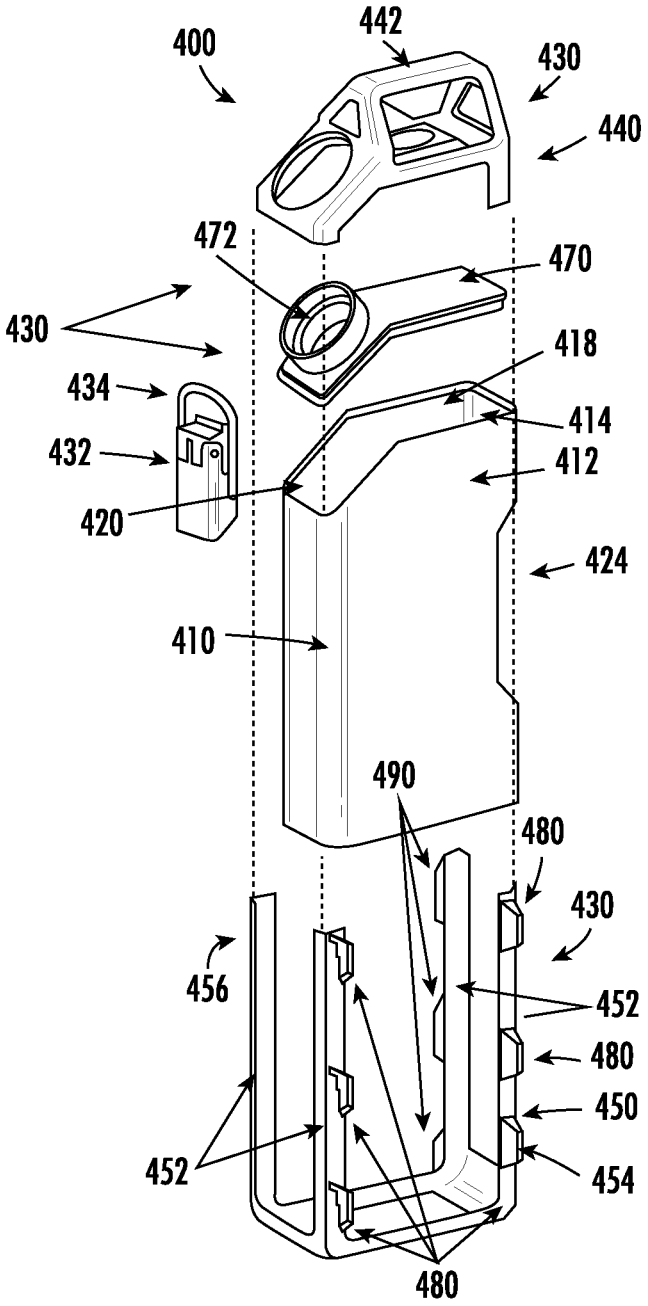
FIG. 21 is a perspective front view of a drinking container, according to another embodiment.

In various embodiments, the plurality of male couplers 150 extend from a first side 126 of the support structure 130 and the plurality of female couplers 170 extend from a second side 128 of the support structure 130 opposite the first side 126. In various embodiments, the first side of the support structure (e.g., first side 126) and the second side of the support structure (e.g., second side 128) are integrally molded together (e.g., see FIG. 21). In various embodiments, the first side of the support structure (e.g., first side 126) and the second side of the support structure (e.g., second side 128) are detachably coupled together (e.g., see FIGS. 1-6).

Figure 5:
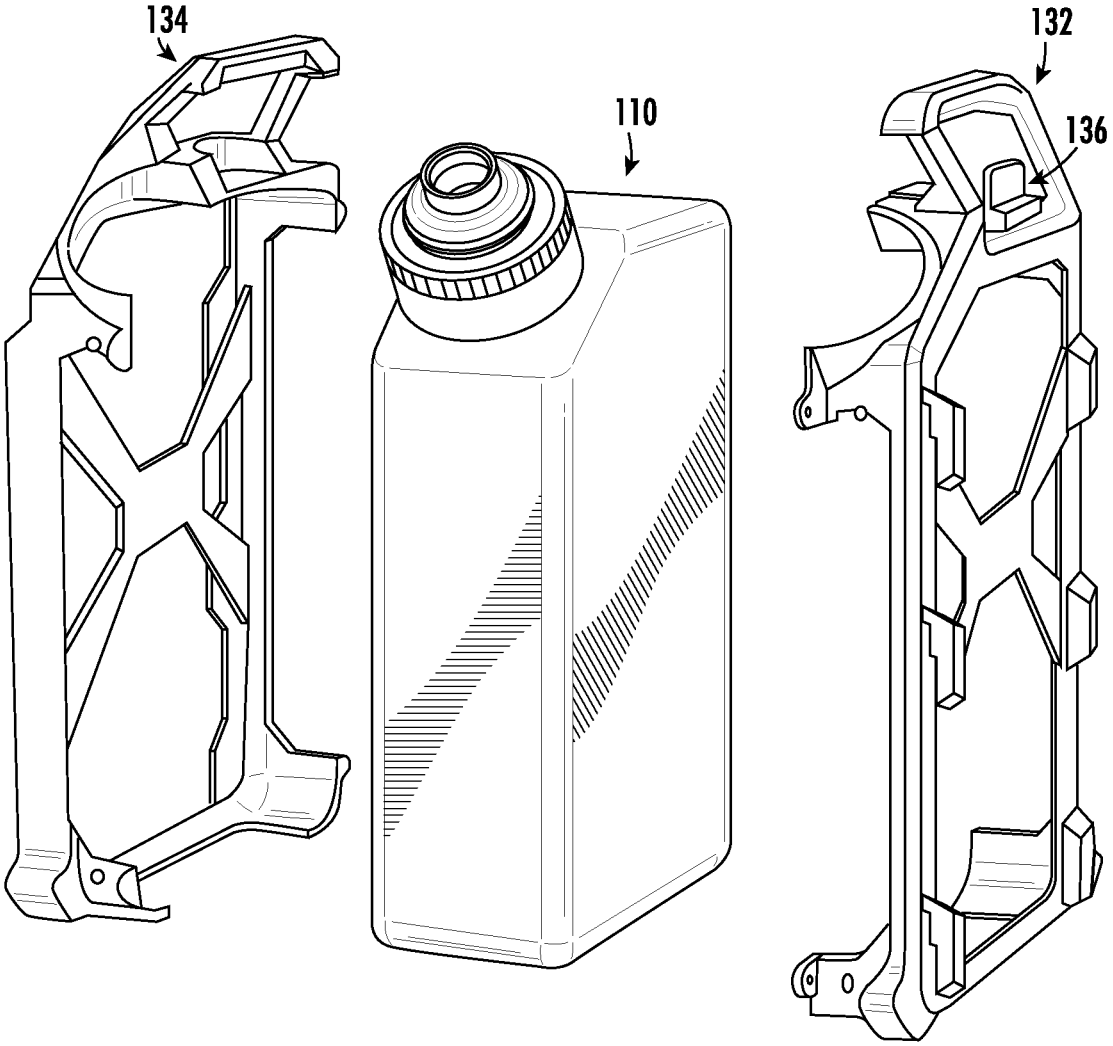
FIG. 5 is a perspective view of the drinking container of FIG. 1 shown with the support structure separated, according to an exemplary embodiment.

Referring to FIG. 5, in various embodiments first element 132 and second element 134 are detachably coupled. Thus, storage body 110 can be removed from first element 132 and second element 134 and a different storage body can be inserted between and secured within first element 132 and second element 134.

Figure 6:
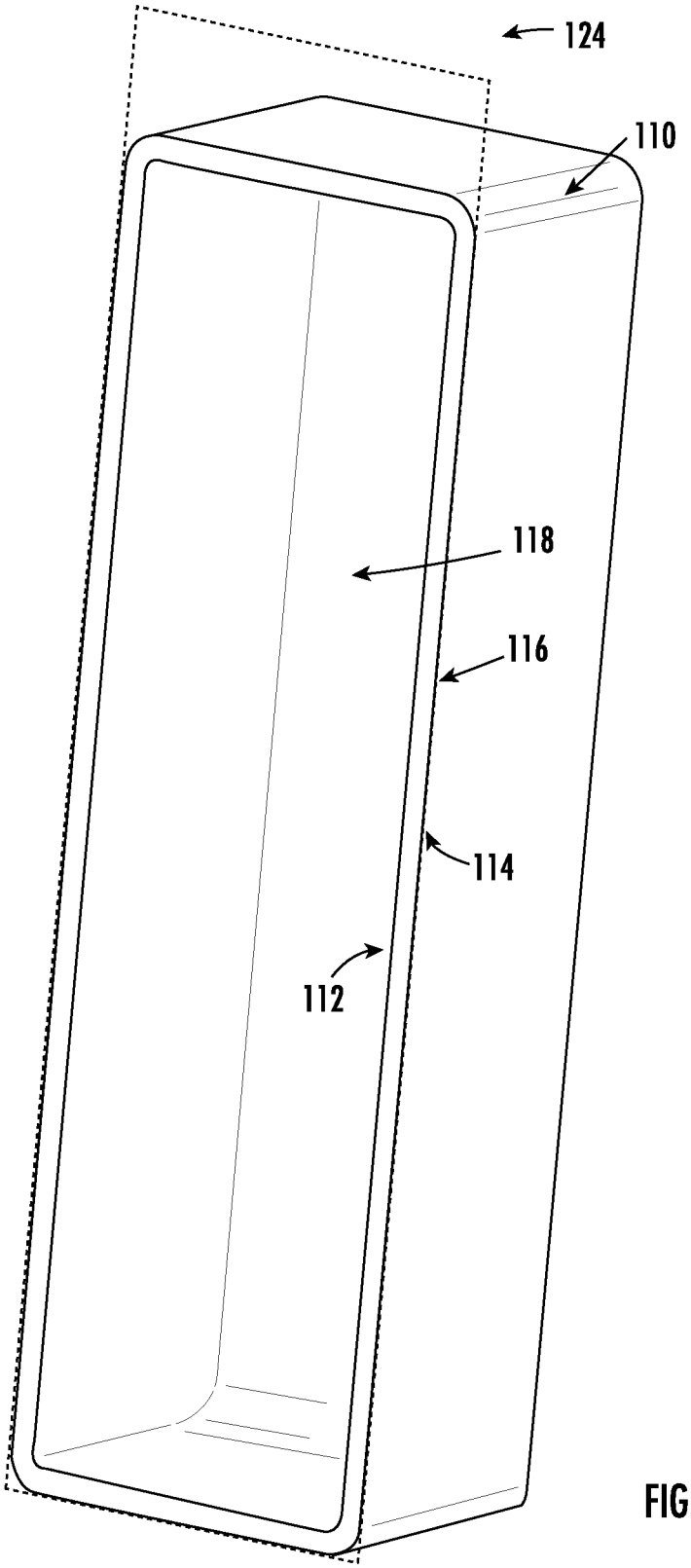
FIG. 6 is a cross-section view of the storage body of the drinking container of FIG. 1, according to an exemplary embodiment.

Referring to FIG. 6, various aspects of storage body 110 are shown. Storage body 110 includes inner wall 112 and outer wall 114, which peripherally surrounds inner wall 112 that define vacuum-insulated area 116 between inner wall 112 and outer wall 114. In various embodiments, area 116 includes a vacuum and/or a reduced pressure such that area 116 thermally insulates inner wall 112 and outer wall 114 from each other. Area 116 provides thermal insulation between the containment area 118 and an exterior 124 of the storage body 110. Storage body 110 includes containment area 118, which is configured to receive and store a pourable material, such as a liquid for consumption.

Figure 7:
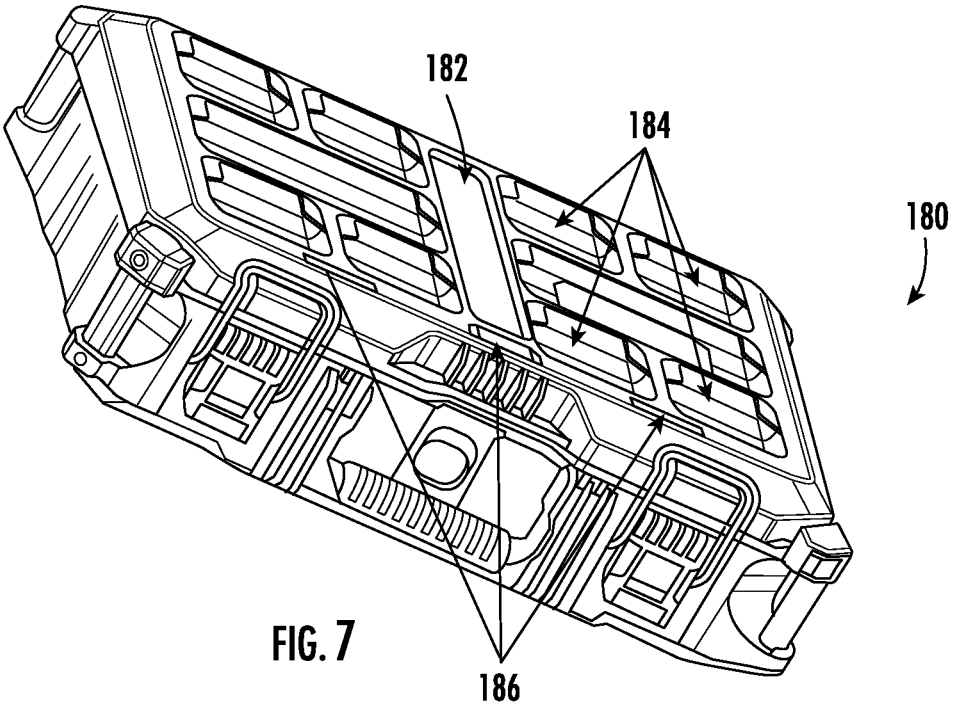
FIG. 7 is a top perspective view of a utility module, according to an exemplary embodiment.
Figure 8:
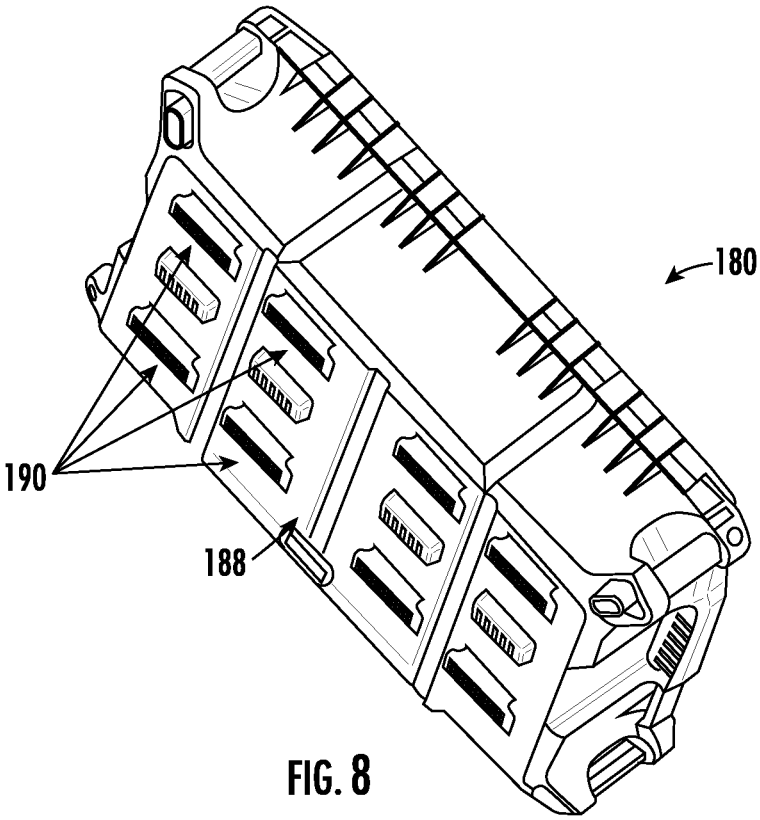
FIG. 8 is a bottom perspective view of the utility module of FIG. 7, according to an exemplary embodiment.
Figure 9:
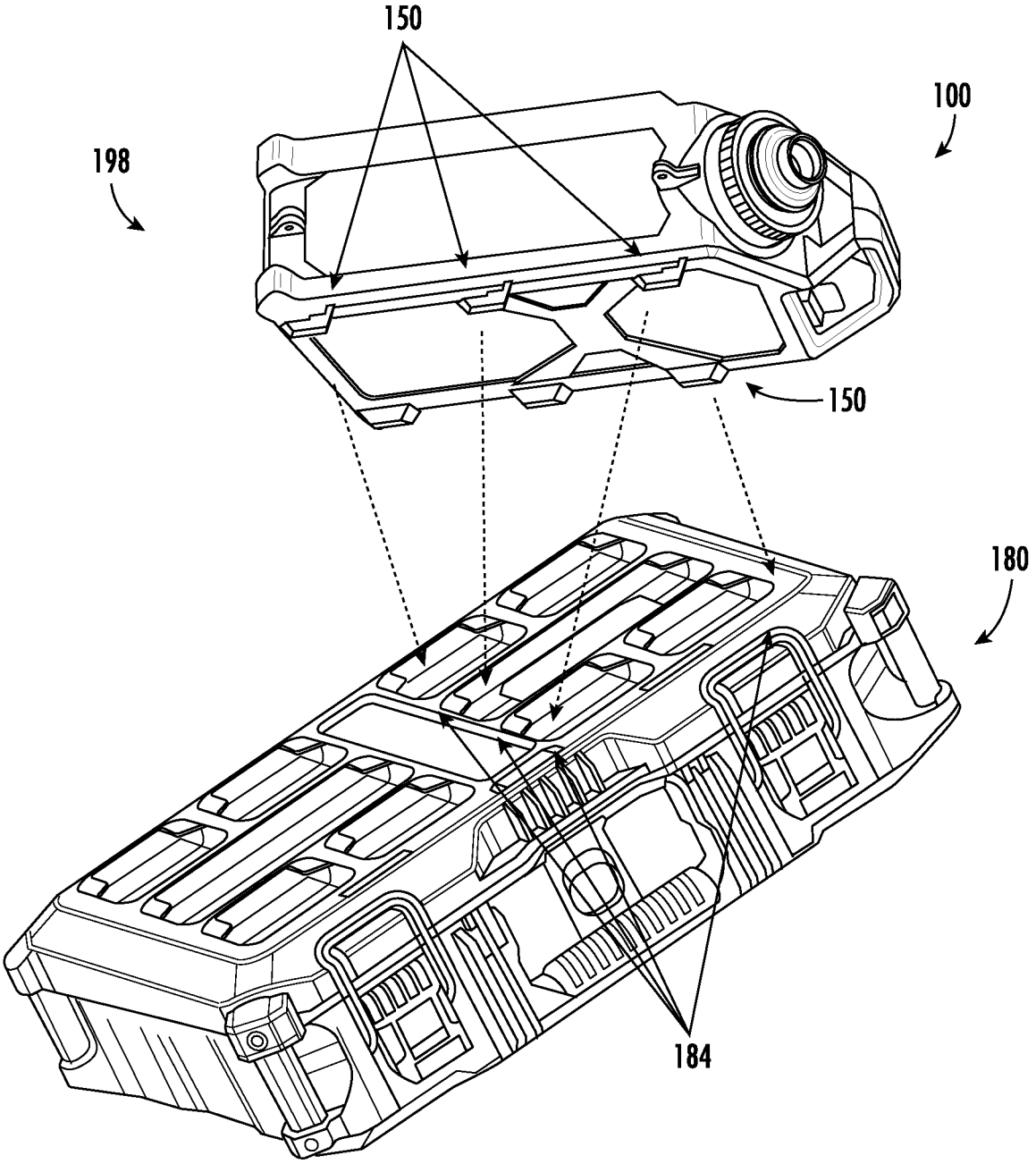
FIG. 9 is an exploded view of the drinking container of FIG. 1 and the utility module of FIG. 7, according to exemplary embodiments.

Referring to FIGS. 7-9, various aspects of a utility module 180 are shown. Utility module 180 can be used within a modular system that includes multiple utility modules and/or containers stacked and secured to each other. Utility module 180 includes first side 182 and second side 188 opposite first side 182. Utility module 180 includes female couplers 184 extending from first side 182 and latch recesses 186 defined by first side 182. As will be shown, male couplers 150 of container 100 are configured to detachably couple with female couplers 184 of utility module 180.

Utility module 180 includes male couplers 190 extending from second side 188. Male couplers 190 are configured to couple with female couplers of containers (e.g., female couplers of container 100 and/or female couplers 270 of container 200).

Referring to FIG. 9, an exploded view of modular system 198 is shown. Modular system 198 includes container 100 and utility module 180. The male couplers 150 of container 100 couple with the female couplers 184 of utility module (e.g., the dash-dot lines extend between male couplers 150 and female couplers 184 that will be engaged with each other when container 100 and utility module 180 are coupled together).

In various embodiments, the coupling structures described herein are compatible with the coupling mechanism(s) described in International Patent Application No. PCT/US2018/044629, which is hereby incorporated by references in its entirety. For exemplary purposes only, male couplers 150, female couplers of container 100, latch 136, female couplers 270 of container 200, male couplers 250 of container 200, male couplers 350 of container 300, female couplers 490 of container 400, and/or male couplers 480 of container 400 are compatible with the coupling mechanism(s) described in International Patent Application No. PCT/US2018/044629.

Figure 10:
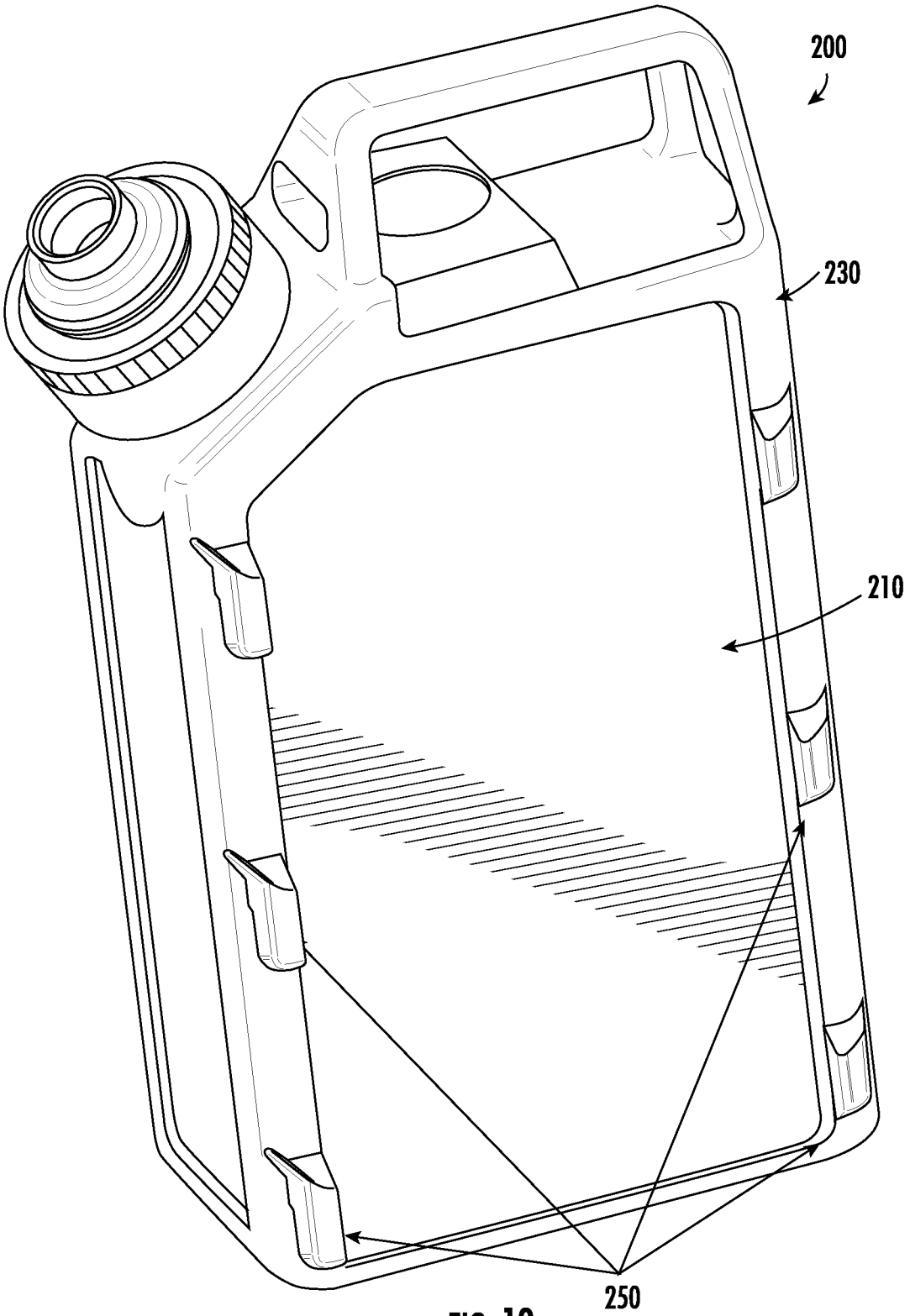
FIG. 10 is a perspective front view of a drinking container, according to another embodiment.

Referring to FIGS. 10-11, various aspects of container 200 are shown. Container 200 is substantially the same as container 100 except for the differences discussed herein.

Container 200 includes male couplers 250 and female couplers 270. In various embodiments, male couplers 250 extend on a first side of container 200, and female couplers 270 extend on an opposing second side of container 200. Each female coupler 270 includes a sidewall 272 extending from the support structure 230, and ribs 274 extending from sidewall 272 offset and above support structure 230 and/or storage body 210. In various embodiments, ribs 274 include an angled leading surface 276 facing towards a top of storage body 210 and away from sidewall 272.

Referring to FIGS. 12-17, various mechanisms to couple elements of support structures are shown. In particular, coupling structures 280, 282, 284, 286, 288, and 290 detachably couple multiple elements (e.g., two opposing elements) of support structures.

Figure 18:
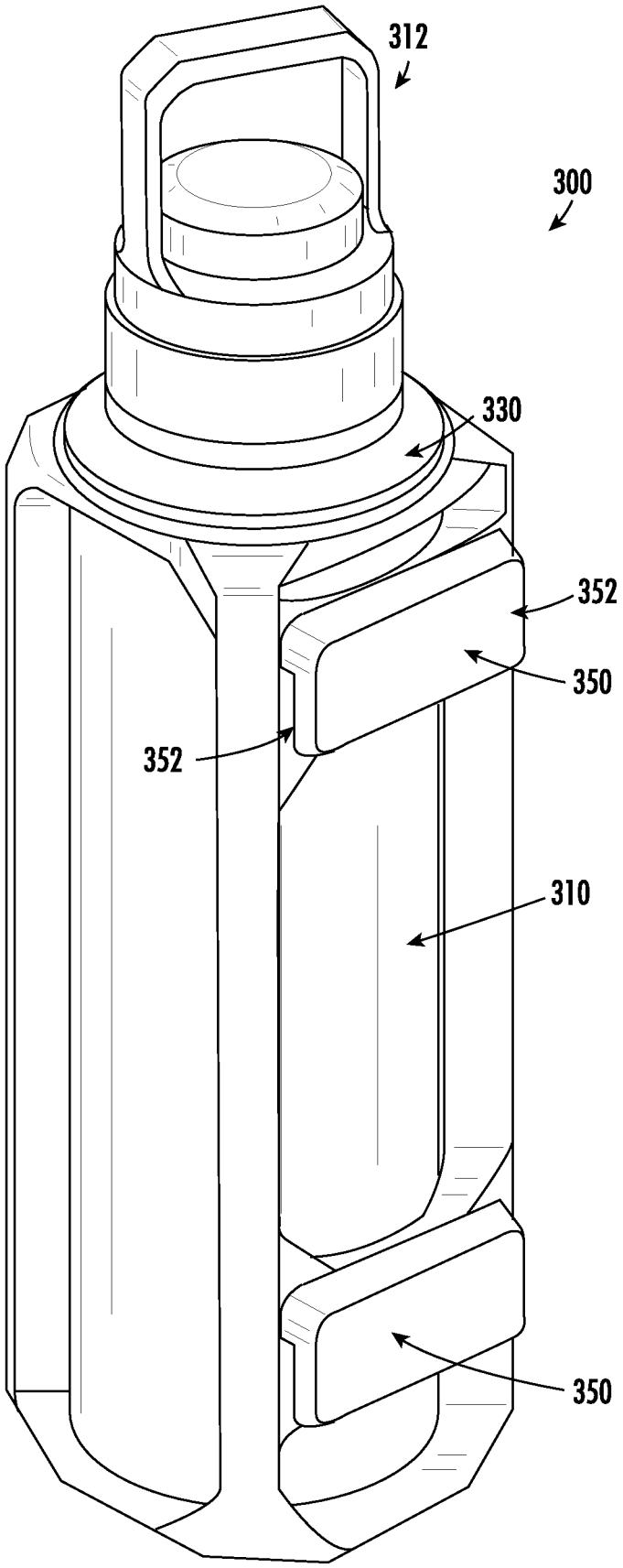
FIG. 18 is a perspective front view from above of a drinking container, according to another embodiment.
Figure 19:
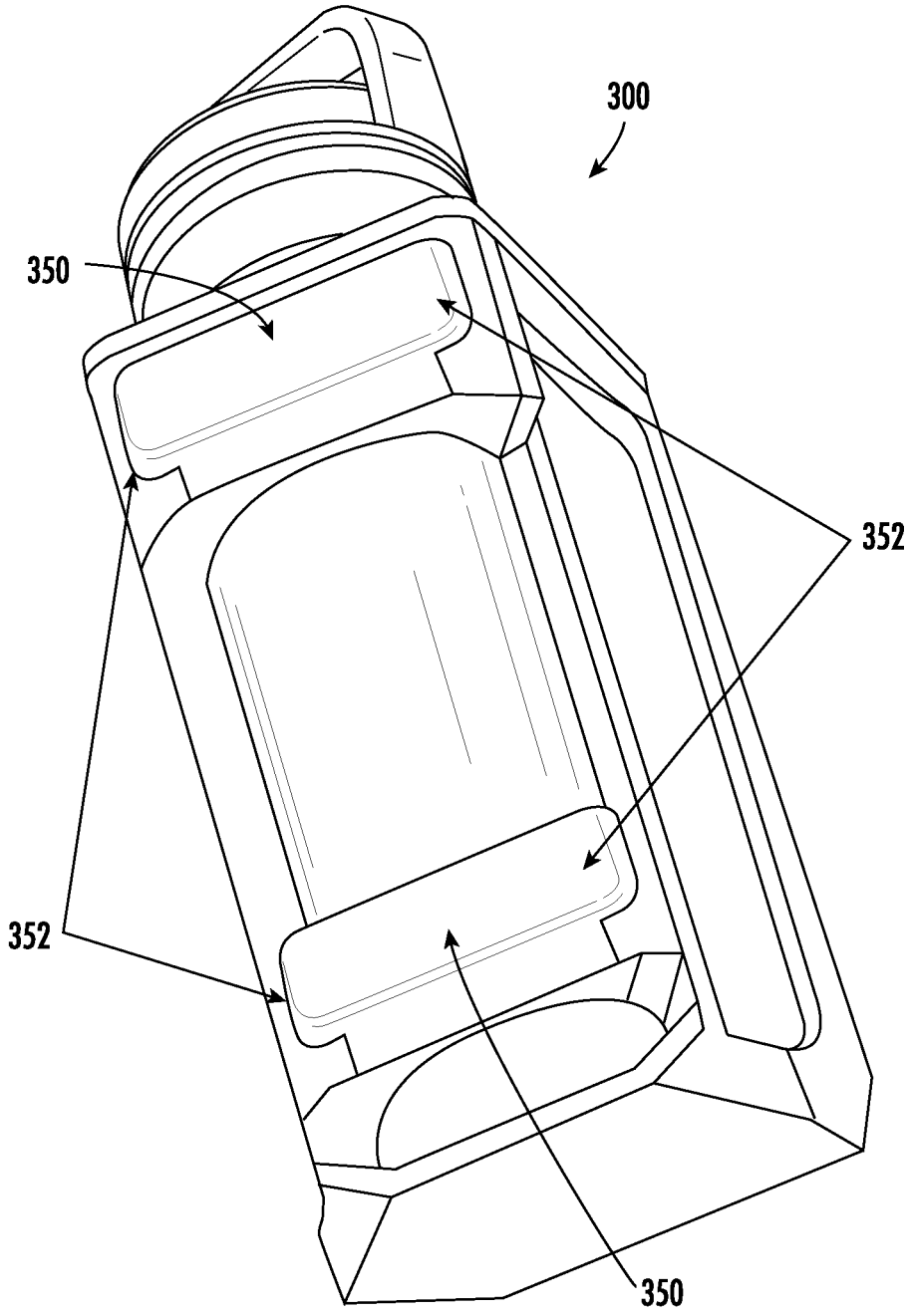
FIG. 19 is a perspective front view from below of the drinking container of FIG. 18, according to an exemplary embodiment.
Figure 20:
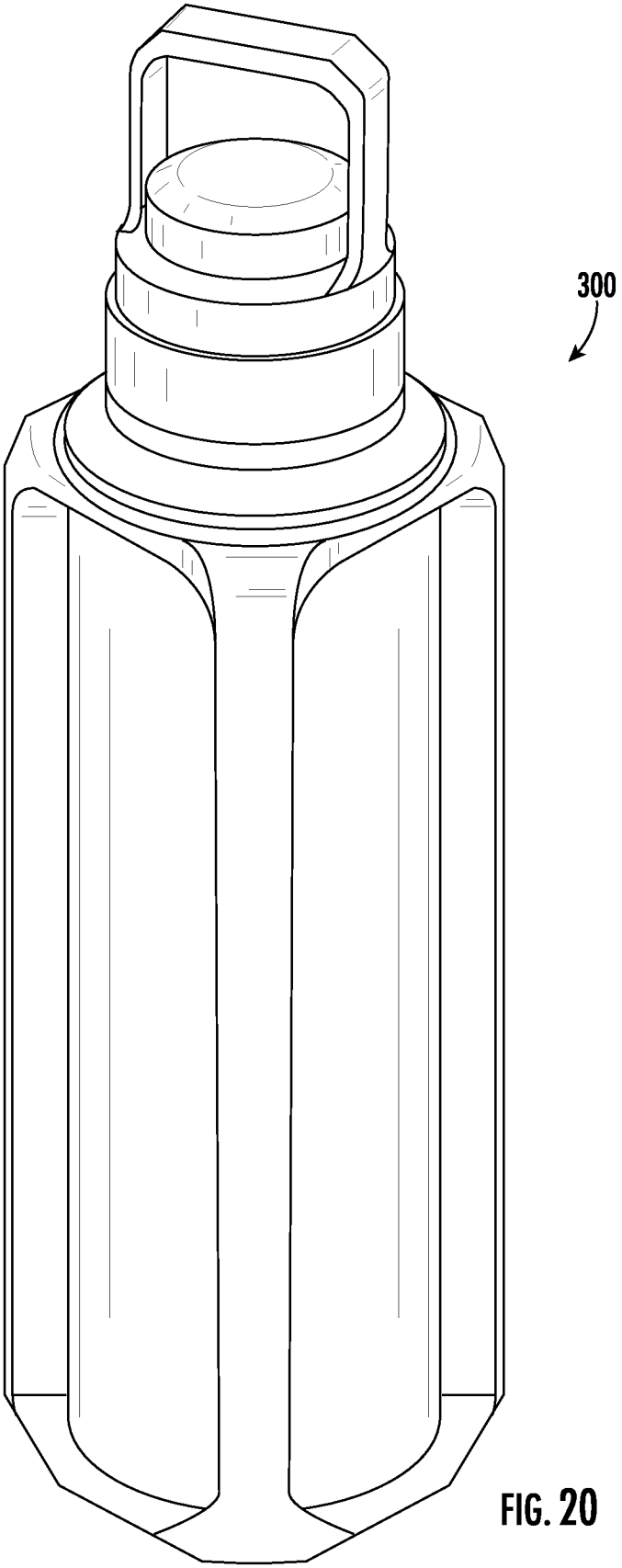
FIG. 20 is a perspective rear view of the drinking container of FIG. 18, according to an exemplary embodiment.

Referring to FIGS. 18-20, various aspects of container 300 are shown. Container 300 is substantially the same as container 100 or container 200 except for the differences discussed herein.

Container 300 includes storage body 310 and a cap 312 detachably secured to storage body 310 to close the opening for the pourable material containment area. A plurality of male couplers 350 extend from support structure 330. In various embodiments, male couplers 350 each include two tongues 352, which are on opposing ends of the respective male coupler 350.

Referring to FIGS. 21-25, various aspects of container 400 are shown. Container 400 is substantially the same as container 100, container 200, or container 300 except for the differences discussed herein.

Container 400 includes storage body 410, support structure 430 coupled to storage body 410, and lid 470 coupled to storage body 410 via support structure 430. Lid 470 defines opening 472 that provides fluid communication between containment area 418 and exterior 424 of container 400 and storage body 410.

Support structure 430 includes upper structure 440, lower structure 450, and latch 432 that detachably secures upper structure 440 and lower structure 450 to each other around storage body 410. In various embodiments, latch 432 is coupled to one of upper structure 440 and lower structure 450 (e.g., lower structure 450), and subsequently arm 434 of latch 432 detachably couples to the other of upper structure 440 and lower structure 450 (e.g., upper structure 440). Thus, latch 432 rigidly couples upper structure 440 and lower structure 450 together around storage body 410 and secures the lid 470 to the opening 420 of storage body 410.

In various embodiments, upper structure 440 includes handle 442 extending above and offset from storage body 410. Handle 442 facilitates a user transporting container 400, such as by grabbing handle 442.

Lower structure 450 includes arms 452, such as four arms 452 extending along each lateral corner of storage body 410. Male couplers 480 extend from a first side 454 of lower structure 450, and female couplers 490 extend from a second side 456 of lower structure 450 opposite first side 454. In various embodiments, male couplers 480 are structurally and functionally the same as male couplers 150 extending from container 100. In various embodiments, female couplers 490 are structurally and functionally the same as female couplers 270 extending from container 200.

Storage body 410 includes internal shell 412, external shell 414, and bottom plate 416 coupled to a bottom of external shell 414. Storage body 410 defines containment area 418, which is used to store objects, such as a pourable material, such as a liquid to be consumed. The pourable material can exit storage body 410 via opening 420 at the top of storage body 410. In various embodiments, storage body 410 includes a recess 426 that facilitates a user picking up storage body 410. In various embodiments, storage body 410 is a five-sided vacuum insulated container.

Figure 22:
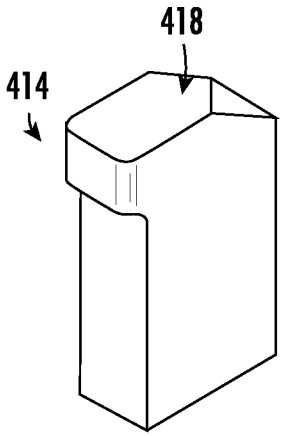
FIGS. 22-25 depicts various components of the drinking container of FIG. 21, according to an exemplary embodiment.
Figure 23:
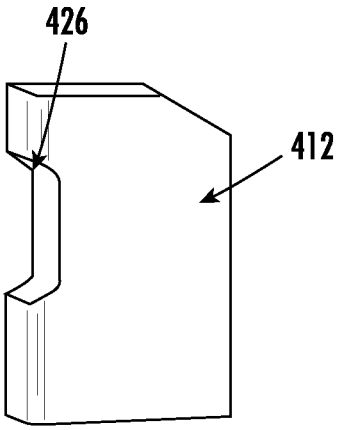
Figure 24:
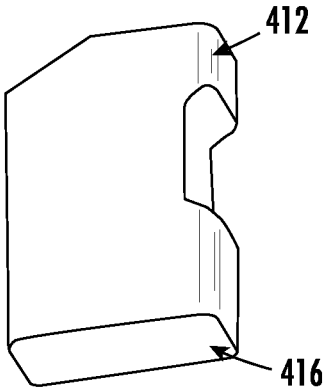
Figure 25:
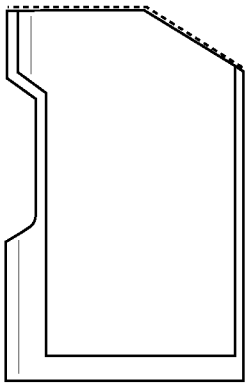

Referring to FIGS. 22-25, various aspects of an exemplary method of manufacturing storage body 410 are shown. First, internal shell 412 is provided, such as via being manufactured as a single contiguous piece or via coupling two or more components, such as two halves (FIG. 22). External shell 414 is then provided, and internal shell 412 is welded inside external shell 414 (FIG. 23). Bottom plate 416 is then coupled to external shell 414, such as via being coupled to a bottom of external shell 414 (FIG. 24). Upper portions of internal shell 412 and external shell 414 are then welded together (FIG. 25).

Figure 26:
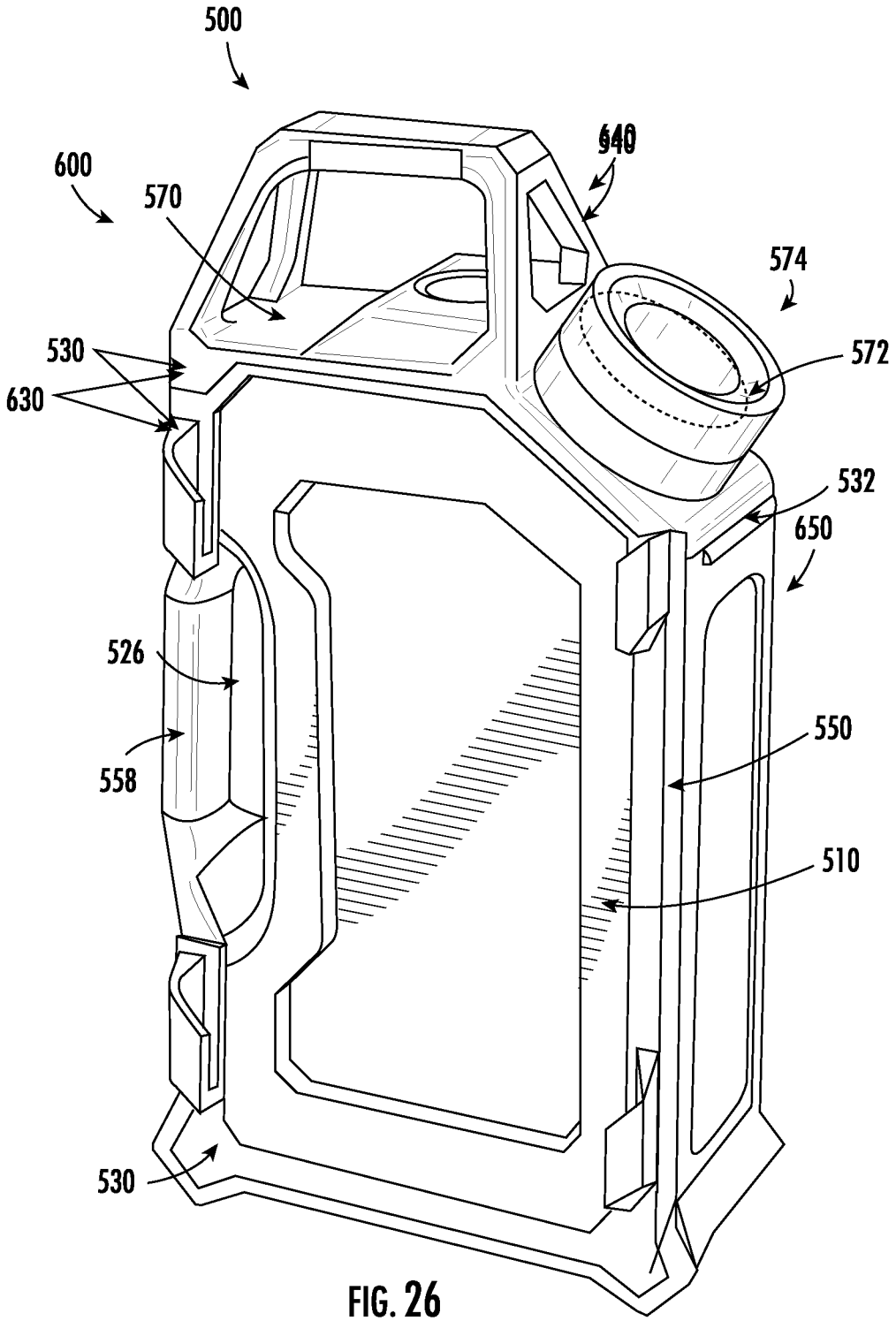
FIG. 26 is a perspective front view of a drinking container, according to another embodiment.

Referring to FIG. 26, various aspects of container 500 are shown. Container 500 is substantially the same as container 100, container 200, container 300, or container 400 except for the differences discussed herein.

In particular, upper structure 540 is pivotally coupled to lower structure 550 via hinge 532. Thus, upper structure 540 and lower structure 550 pivotally actuate with respect to each other between a closed position (FIG. 26) and an open position. When in the closed position, upper structure 540 and lower structure 550 couple lid 570 to storage body 510. Recess 526 in a lateral portion of storage body 510 facilitates a user grasping handle 558 to transport container 500. Container 500 includes closure 574, which is coupled to lid 570 over opening 572.

Figure 27:
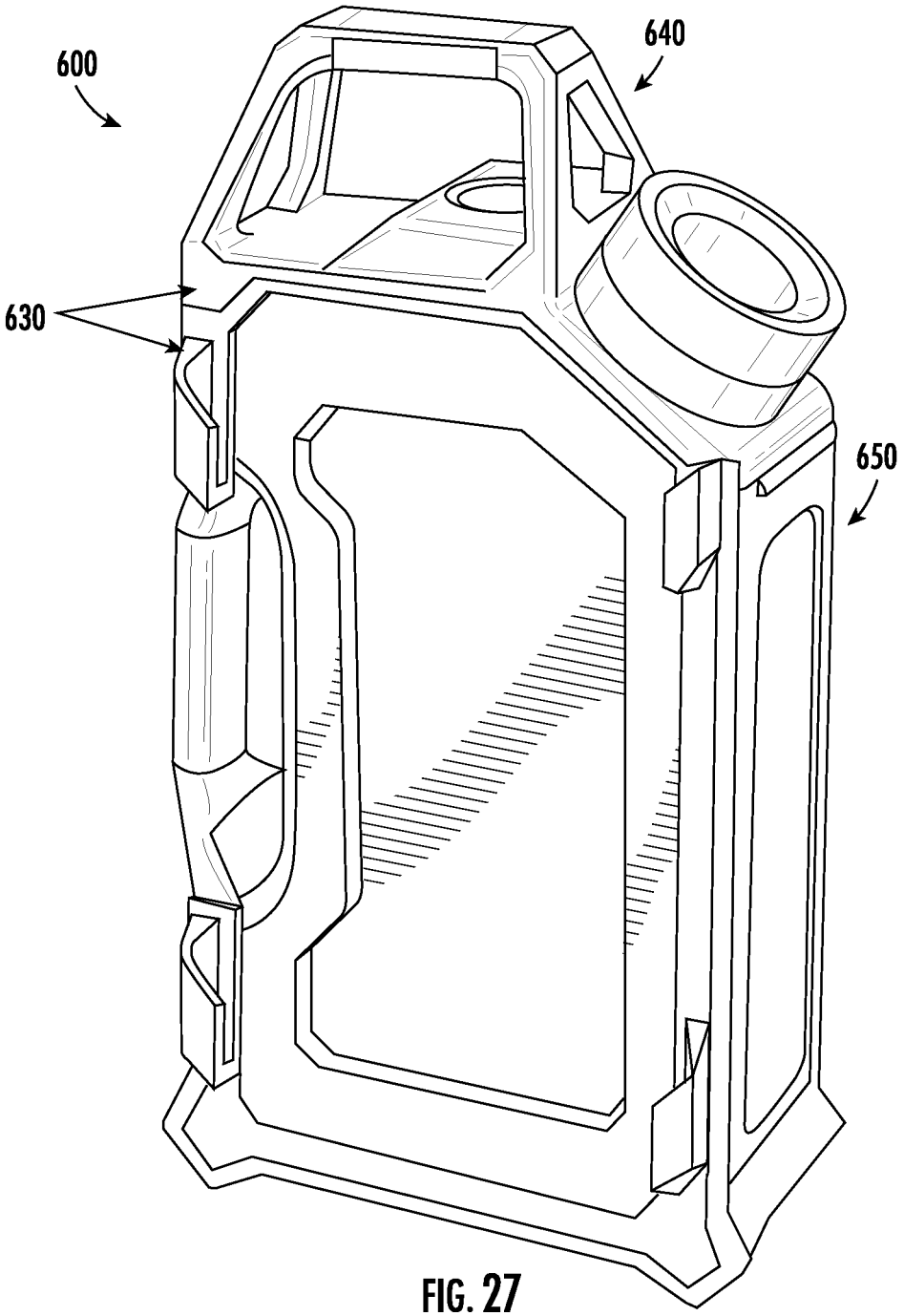
FIG. 27 is a perspective front view of a drinking container, according to another embodiment.

Referring to FIG. 27, various aspects of container 600 are shown. Container 600 is substantially the same as container 100, container 200, container 300, container 400, or container 500 except for the differences discussed herein. In particular, upper structure 640 of support structure 630 and lid 670 are a different color than lower structure 650 of support structure 630.

In various embodiments, the container(s) include four components, such as four stainless steel components. In various embodiments, the container(s) are easy to clean, such as via separating the container(s) into the component parts. In various embodiments, a vent can be added to the lid (e.g., an opening to the rear of the lid to provide fluid communication for air to enter the container when pourable material is exiting the container through the circular opening in front). In various embodiments, the components are welded together using a larger weld compared to other products, thereby improving structural stability.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature. As used herein, "rigidly coupled" refers to two components being coupled in a manner such that the components move together in a fixed positional relationship when acted upon by a force.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A container configured to pour a pourable material, the container comprising:

a storage body defining a containment area configured to receive a pourable material, the storage body extending along a primary longitudinal axis;

an opening defined by the storage body, the opening providing fluid communication between the containment area and an exterior of the storage body;

a support structure detachably coupled to the storage body; and a plurality of female couplers extending from the support structure, each of the plurality of female couplers comprising:

a sidewall extending from the support structure; and a rib extending from the sidewall above and offset from the storage body, wherein the support structure, the sidewall, and the rib collectively define a channel parallel to the primary longitudinal axis;

wherein the plurality of female couplers comprise a lower female coupler and an upper female coupler, the lower female coupler defining a first channel extending from a closed end at a bottom of the support structure to an open end, and the upper female coupler defining a second channel extending from an open lower end to an open upper end, wherein the first channel and the second channel extend parallel to the primary longitudinal axis.

2. The container of claim 1, wherein the plurality of female couplers are arranged in a grid comprising at least two rows of female couplers and at least two columns of female couplers.

3. The container of claim 1, comprising a plurality of male couplers extending from the support structure, each of the plurality of male couplers comprising:

a backwall extending from the support structure;

an interior wall extending from the support structure; and a tongue extending from the interior wall and backwall offset from and above the support structure, wherein the support structure, the backwall, the interior wall, and the tongue collectively define a channel that extends from a closed back end at the backwall to an open front end opposite the closed back end.

4. The container of claim 3, wherein the plurality of male couplers extend from a first side of the support structure and the plurality of female couplers extend from a second side of the support structure opposite the first side.

5. The container of claim 4, wherein the first side of the support structure and the second side of the support structure are integrally molded together.

6. The container of claim 4, wherein the first side of the support structure and the second side of the support structure are detachably coupled together.

7. The container of claim 3, wherein the plurality of male couplers are arranged in a grid comprising at least two rows of male couplers and at least two columns of male couplers.

8. The container of claim 3, the container comprising a latch, wherein one or more of the plurality of male couplers are configured to engage with a utility module to detachably couple the support structure to the utility module, and wherein the latch is configured to interface with the utility module to prevent sliding disengagement of the one or more plurality of male couplers from the utility module.

9. The container of claim 1, wherein the storage body is formed from a first material comprising a metal.

10. The container of claim 1, wherein the first channel and the second channel are aligned with each other such that a single axis extends through both the first channel and the second channel.

11. A container configured to pour a pourable material, the container comprising:

a storage body defining a containment area configured to receive a pourable material, the storage body extending along a primary longitudinal axis;

an opening defined by the storage body, the opening providing fluid communication between the containment area and an exterior of the storage body;

a support structure detachably coupled to the storage body; and a plurality of male couplers extending from the support structure, a first subset of the plurality of male couplers extending from a first outer edge of the support structure and a second subset of the plurality of male couplers extending from a second outer edge of the support structure opposite the first edge, each of the plurality of male couplers comprising:

a backwall extending from the support structure;

an interior wall extending from the support structure; and a tongue extending from the interior wall offset from and above the support structure, wherein the support structure, the backwall, the interior wall, and the tongue collectively define a channel parallel to the primary longitudinal axis, and wherein the channel extends from a closed back end at the backwall to an open front end opposite the closed back end.

12. The container of claim 11, wherein the plurality of male couplers are arranged in a grid comprising at least two rows of male couplers and at least two columns of male couplers, the container comprising a latch, wherein one or more of the plurality of male couplers are configured to engage with a utility module to detachably couple the support structure to the utility module, and wherein the latch is configured to interface with the utility module to prevent sliding disengagement of the one or more plurality of male couplers from the utility module.

13. The container of claim 12, the container comprising a plurality of female couplers extending from the support structure, each of the plurality of female couplers comprising:

a sidewall extending from the support structure; and a rib extending from the sidewall above and offset from the storage body, wherein the support structure, the sidewall, and the rib collectively define a channel parallel to the primary longitudinal axis, and wherein the channel extends from an open back end to an open front end.

14. The container of claim 13, wherein the plurality of female couplers are arranged in a grid comprising at least two rows of female couplers and at least two columns of female couplers.

15. A container configured to pour a pourable material, the container comprising:

a storage body defining a containment area configured to receive pourable materials, the storage body comprising an inner wall and an outer wall that define a vacuum-insulated area between the inner wall and the outer wall, the vacuum-insulated area providing thermal insulation between the containment area and an exterior of the storage body, the storage body is formed from a first material comprising a metal;

an opening defined by the storage body, the opening providing fluid communication between the containment area and the exterior of the storage body;

a support structure detachably coupled to the storage body, the support structure formed from a second material comprising a plastic;

a plurality of female couplers extending from the support structure, the plurality of female couplers configured to detachably couple the support structure to a modular storage system, wherein a first subset of the plurality of female couplers extend from a first edge of the support structure to an opposing second edge, and wherein a second subset of the plurality female couplers extend from the second edge of the support structure to the first edge; and wherein the plurality of female couplers comprise a first lower female coupler and a second lower female coupler, the first lower female coupler defining a first channel extending from a closed end at a bottom of the support structure to an open end, and the second lower female coupler defining a second channel extending from a closed end at the bottom of the support structure to an open end, wherein the first channel and the second channel extend parallel to the primary longitudinal axis.

16. The container of claim 15, comprising a plurality of male couplers extending from the support structure, each of the plurality of male couplers comprising:

a backwall extending from the support structure;

an interior wall extending from the support structure; and a tongue extending from the interior wall offset from and above the support structure, wherein the support structure, the backwall, the interior wall, and the tongue collectively define a channel, and wherein the channel extends from a closed back end at the backwall to an open front end opposite the closed back end.

17. The container of claim 16, each of the plurality of female couplers comprising:

a sidewall extending from the support structure; and a rib extending from the sidewall above and offset from the storage body, wherein the support structure, the sidewall, and the rib collectively define a channel.

18. The container of claim 17, wherein the plurality of male couplers extend from a first side of the support structure and the plurality of female couplers extend from a second side of the support structure opposite the first side, and wherein the first side of the support structure and the second side of the support structure are integrally molded together.

19. The container of claim 17, wherein the plurality of male couplers extend from a first side of the support structure and the plurality of female couplers extend from a second side of the support structure opposite the first side, and wherein the first side of the support structure and the second side of the support structure are detachably coupled together.

20. The container of claim 17, the container comprising a latch, wherein one or more of the plurality of male couplers are configured to engage with a utility module in the modular storage system to detachably couple the support structure to the utility module, and wherein the latch is configured to interface with the utility module to prevent sliding disengagement of the one or more plurality of male couplers from the utility module.

21. The container of claim 15, each of the plurality of female couplers comprising:

a sidewall extending from the support structure; and a rib extending from the sidewall above and offset from the storage body, wherein the support structure, the sidewall, and the rib collectively define a channel.

22. The container of claim 15, wherein a rib of a first female coupler of the first subset and a rib of a second female coupler of the second subset extend towards each other such that no portion of the support structure intersects an axis extending between the rib of the first female coupler and the rib of the second female coupler.

* * * * *